US005865348A

United States Patent [19]

Harding

[11] Patent Number: 5,865,348

[45] Date of Patent: Feb. 2, 1999

[54] HAND WEIGHT SELF DEFENSE SPRAY

[75] Inventor: David D. Harding, 7305 Meadowood Dr., Austin, Tex. 78723

[73] Assignee: David D. Harding, Austin, Tex.

[21] Appl. No.: 802,140

[22] Filed: Feb. 19, 1997

[51] Int. Cl.[6] ..... B67D 5/00

[52] U.S. Cl. ..... 222/192; 222/175; 482/108

[58] Field of Search ..... 222/175, 192, 222/78; 482/106–108; 224/148.1, 148.4, 148.7

[56] References Cited

U.S. PATENT DOCUMENTS 4,351,526 9/1982 Schwartz ..... 272/122

5,242,349 9/1993 Reiff et al. ..... 482/106

5,325,997 7/1994 Washington et al. ..... 222/175

*Primary Examiner*—J. Casimer Jacyna

*Assistant Examiner*—Steven O. Douglas

[57] ABSTRACT

A device for exercise and self-protection comprising a combination of hand-weights and a canister of pepper spray. The device includes a hollow handle with two openings, one for the thumb of a user and one for the spray from a canister of pepper spray inserted within the hollow handle. The device further includes threaded ends for accommodating a set of real or fake weights.

1 Claim, 2 Drawing Sheets

HAND WEIGHT SELF DEFENSE SPRAY

CROSS REFERENCE TO RELATED APPLICATION

This application is a new application combining the use of a hand-weights with a pepper spray (type) canister in the handle for self defense. Prior applications have either been for one use or the other but not in a combination.

BACKGROUND OF THE INVENTION

Field of the Invention

This invention relates in general to a combination hand-weights and self-defense spray for personal protection. No past devices were found to have been proposed that used the combination of hand-weights and a pepper spray type devices.

The advantage of using this device is that the people who use hand-weights while jogging/running/walking will be able to exercise and have the pepper spray type defense spray ready to use. This device will be designed so that either fake weights (light weight end pieces) or real weights can be used. The weights can be of different heaviness so that people of different fitness levels will be able to use this device effectively. This device is desirable for all who exercise in or outdoors. The device will give people a means of self-defense without having to stop and try to find a pepper spray type of canister before they are attacked either by humans and/or animals.

There has been a need for a device that people could use for both exercise and as a means for self-defense for a long time. For some of the elderly, women, and physically challenged, this device would provide immediate access to a defensive way of protecting oneself or others. Since this device is also disguised, the would-be attacker will be completely taken by surprise, thereby allowing the victim to escape to safety.

SUMMARY OF THE INVENTION

According to the device, a combination of hand-weights and pepper spray type for both exercise and self-protection. The housing consists of a cylindrical cavity (in which a pepper spray style canister can be inserted and openings for the spray and thumb) and threaded ends in which real or fake weights can be screwed in place. The bottom portion of the device can be unscrewed and taken off so that a canister of a pepper spray type can be inserted or replaced.

BRIEF DESCRIPTION OF THE INVENTION

DETAILED DESCRIPTION OF THE INVENTION

Figure 1:
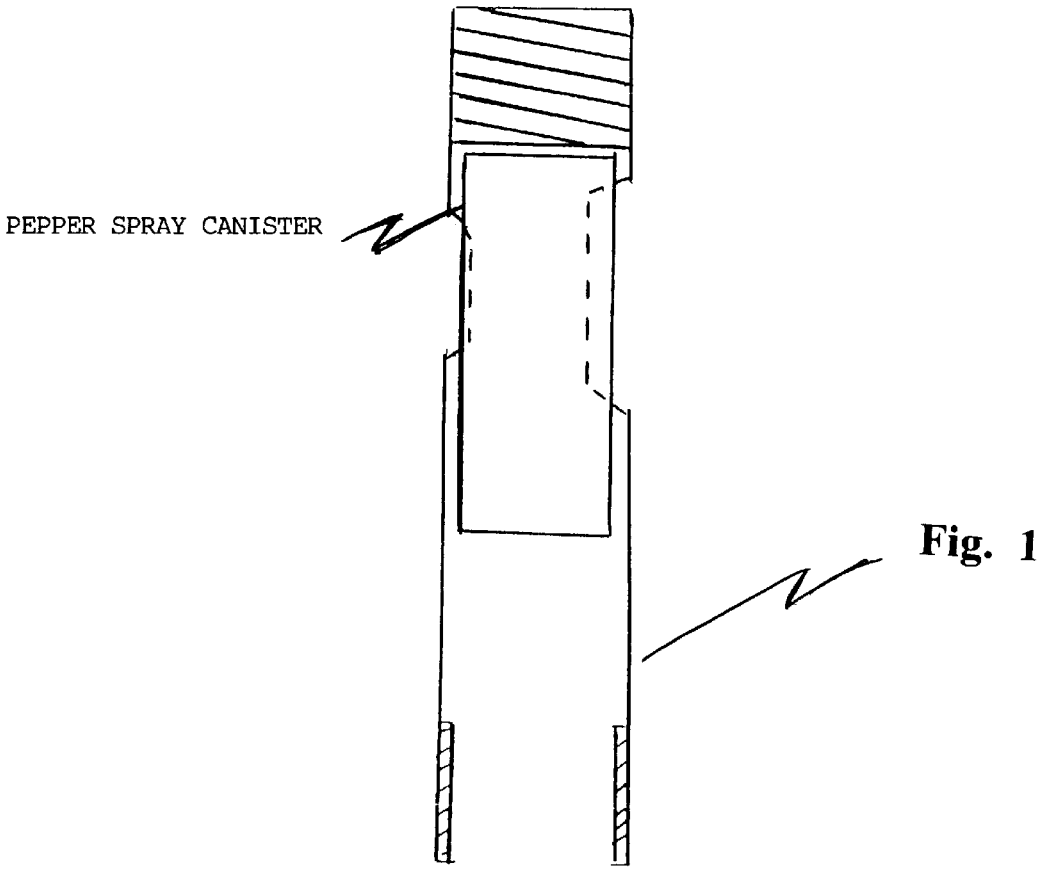
FIG. 1 is a schematic prespective view of the entire device in its entirity as it is ready to be used.
Figure 5:
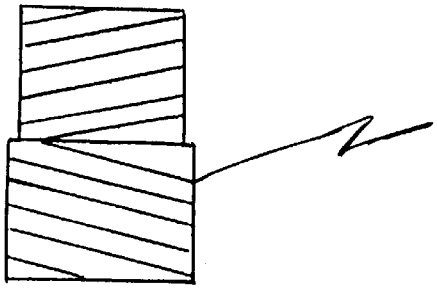
FIG. 5 is a perspective view of the invention.

With reference now to the drawing, and more particularly to FIG. 1 thereof, there is shown the device in its entirity. The real or fake weights are screwed onto the handle that houses the pepper spray type canister. There are two openings, one for the spray to come out of the canister and the other for the thumb to go in and activate the Spray canister.

Figure 2:
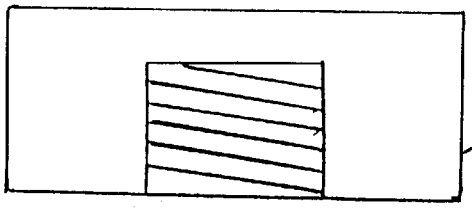
FIG. 2 is a view of the device in its separated state.

With reference now to FIG. 2, the device is in individual parts of the whole. There are five separate parts to this deivce. The handle, the weights on either end of the handle can be either real or fake, spray canister and plug.

Figure 3:
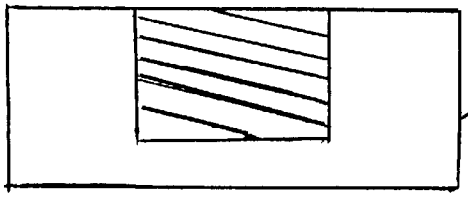
FIG. 3 is a view of a person jogging with the device as it is intended to be used.

With reference now to FIG. 3, a person is jogging with a pair of the devices. This allows the person to exercise with the safety of having a pepper spray canister at the fingertip. The disguise of the hand-weight/spray device will catch the attacker off guard and allow the victim to escape.

Figure 4:
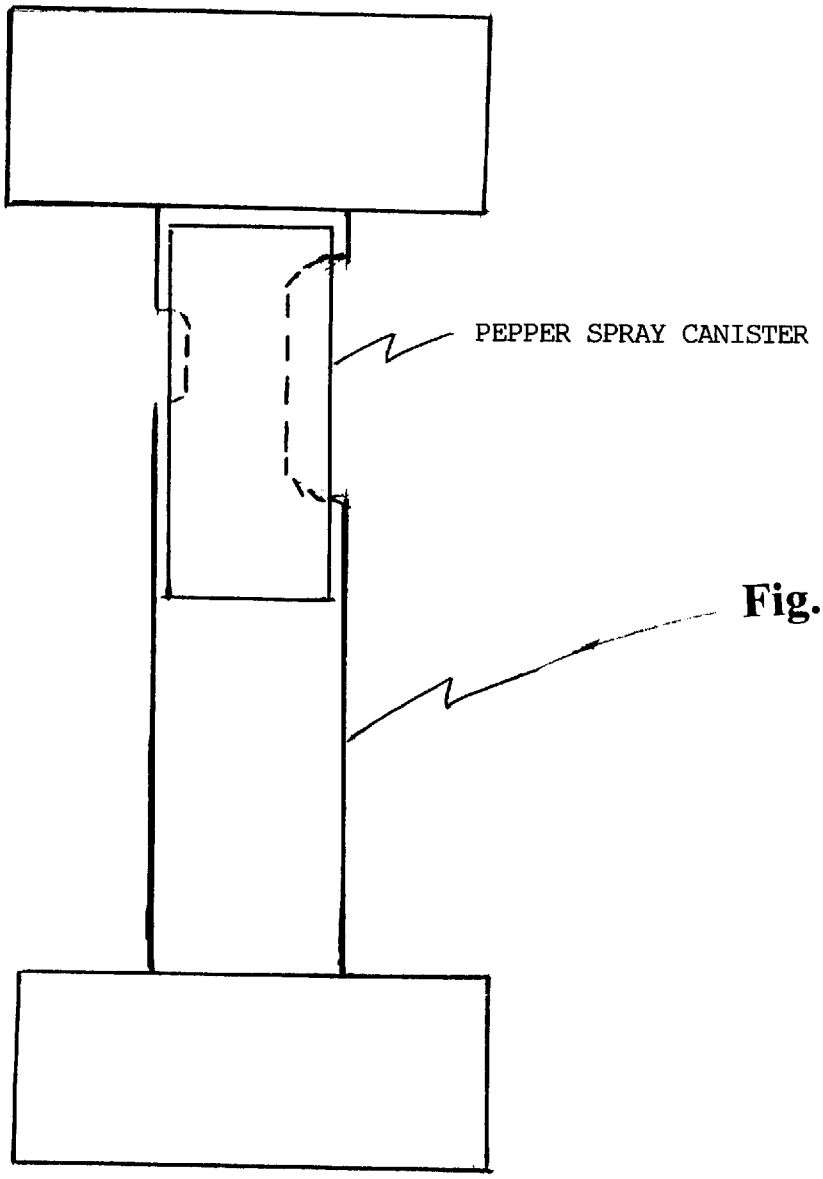
FIG. 4 is the spray had been used on an attacker and the jogger running away.

With reference now to FIG. 4, this drawing shows an attacker had been sprayed in the face by a potential victim. Once the attacker is nuetralized, the victim can get away and get help. The handle 1, of the device can be comprised of either a padded handle or unpadded handle. The handle will have an opening for the thumb to depress the button on the pepper spray type canister. Another opening (smaller in size) on the opposite side from the thumb opening, is for the spray to leave the spray canister of the handle. The weights 2 & 3 can either be made of real weights (different heaviness) or fake weights can be used. It all depends on the level of fitness of the person using the devices. The plug 5 is used to hold the spray canister in place in the handle of the device. The threaded plug is screwed in or out of the handle to replace the pepper spray type canister in the handle. The weight is then screwed on this threaded plug.

What I claim is:

1. An exercise and self defense device comprising, in combination:

a handle that is hollow and has two openings, one for the thumb of a user and one for the spray from a canister of pepper spray placed within the hollow handle, the top and bottom of the handle are threaded;

a plug for screwing into one end of said handle to hold the canister in place; and a set of weights to be threadably attached to each end of said handle.

* * * * *